US005396724A

United States Patent [19]

Dinsmore

[11] Patent Number: 5,396,724

[45] Date of Patent: Mar. 14, 1995

[54] SHIELD ASSEMBLY FOR HIGHWAY SIGNS

[75] Inventor: David W. Dinsmore, Solana Beach, Calif.

[73] Assignee: Joyce Gangewer, San Diego, Calif.

[21] Appl. No.: 121,073

[22] Filed: Sep. 14, 1993

[51] Int. Cl.[6] ..... G09F 19/00

[52] U.S. Cl. ..... 40/612; 52/38; 160/57

[58] Field of Search ..... 40/607, 612, 584, 154, 40/549, 578, 561, 616; D20/39; 52/74, 75, 76, 27, 28, 38; 160/57

[56] References Cited

U.S. PATENT DOCUMENTS

| | | | |
|---|---|---|---|
| 1,135,484 | 4/1915 | Adler | 40/610 |
| 1,460,351 | 6/1923 | Remington | 40/607 |
| 1,739,837 | 12/1929 | Hyman | 40/561 |
| 1,832,196 | 11/1931 | Ferguson | 40/561 |
| 2,618,030 | 11/1952 | Childers et al. | 52/76 |

*Primary Examiner*—Kenneth J. Dorner
*Assistant Examiner*—Joanne Silbermann
*Attorney, Agent, or Firm*—Brown, Martin, Haller & McClain

[57] ABSTRACT

A shield device or assembly for a bridge-mounted highway sign has upper and side panels forming a frame surrounding and projecting outwardly from the upper and side edges of the sign, so as to shield the front face of the sign from view from the bridge. The panels are secured to the sign by upper and side mounting devices, which may be arranged so that the panels flare outwardly at angles greater than 90° to the front face of the sign. Corner pieces fill in the corners between the panels at the upper corners of the sign.

20 Claims, 2 Drawing Sheets

SHIELD ASSEMBLY FOR HIGHWAY SIGNS

BACKGROUND OF THE INVENTION

The present invention relates to a shield assembly for highway signs supported on bridges, for deterring graffiti artists from defacing such signs.

Highway signs are often supported on bridges passing over public highways such as freeways and other roads. Such signs are positioned in a direction facing oncoming traffic. Bridge-supported highway signs are often defaced by graffiti artists, who lean over the bridge side wall or railing and spray messages with paint onto the signs. The sign must then be cleaned by city or transport authorities, and will often be defaced again after cleaning. The cost borne by transport authorities in cleaning graffiti from highway signs is enormous, and repeated cleaning of such signs is extremely time-consuming.

SUMMARY OF THE INVENTION

It is an object of the present invention to provide a device for shielding highway signs which are supported on bridges in order to deter or prevent defacing of such signs by graffiti artists.

According to the present invention, a shield device for a highway sign is provided, which comprises a panel assembly for securing around at least an upper edge and opposite side edges of the sign, the assembly including an upper shield panel, a securing device for securing the upper shield panel to an upper edge of the sign so that the panel projects outwardly at an angle of greater than 90° to a front face of the sign, a pair of side shield panels, and a securing device for securing the side shield panels to the respective opposite side edges of the sign so that they project outwardly from the front face of the sign.

The panel assembly provides a continuous outwardly projecting hood or rim surrounding the top and sides of the sign, making the face of the sign significantly less accessible to persons attempting to spray paint onto the sign. The upper shield panel is angled upwardly, so that a person leaning down over the bridge side wall is unable to see the face of the sign and will be unable to easily climb onto the upper panel to gain access to the sign. Preferably, the upper panel projects upwardly at an angle of 45° to the top of the sign. The side panels preferably project outwardly at a similar smaller angle to the sides of the sign. The resultant flared-out peripheral rim of the sign will significantly impede vision of the sign from the bridge, so that a person cannot effectively spray paint the sign from the safety of the bridge. The panels project outwardly to a sufficient distance that a person would not be able to gain access to the sign by leaning out from the bridge over the sign or to one side of the sign. Preferably, the width of each panel is around two feet.

Typical highway signs consist of a box-like, rectangular frame having a front face across which a sheet or panel carrying information is secured. A service platform extends along the lower edge of the sign frame and projects outwardly from the frame to allow workers to clean the sign. This has a safety railing which may be folded inwardly when not in use. In a preferred embodiment of the invention, the upper panel and side panels each comprise an elongate sheet of metal of predetermined length matching that of the side and upper edge of the sign. The securing or mounting device for the upper panel preferably comprises an angle bar having two perpendicular surfaces or legs, a first leg being adapted for securing across an upper member of a highway sign frame so that the other leg projects upwardly perpendicular to the upper edge of the frame. A series of spaced ribs or rafters are secured to the angle bar at spaced intervals along the length of the bar so as to project upwardly at an angle of 45° to each leg of the angle bar. The upper panel is supported on the ribs and secured to them prior to installation of the angle bar onto a highway sign frame.

Preferably, equivalent mounting devices are provided for securing each side panel to the respective side of the highway sign frame. Thus, each securing device for the side panels also comprises an angle bar with a series of spaced ribs secured to the angle bar so as to project outwardly at an angle from a side member of the highway sign frame. The angle of the side ribs may be the same or less than that of the upper ribs.

A pair of corner members are preferably provided to fill the gaps between the upper and side panels at the upper corners of the sign. Each filler member comprises a trapezoidal-shaped sheet of metal having angled side edges for fitting against the outwardly flaring, adjacent end edges of one side panel and the upper panel. The corner members can be suitably secured to the side and upper panels by bending down the angled side edges over the adjacent edge of the respective side and upper panels and securing the parts together by bolting, riveting, welding or the like.

Thus, the assembly forms a three-sided frame completely surrounding the upper and side edges of a sign. With this arrangement, a highway sign secured to an overpass bridge can be shielded from easy access from the bridge itself while leaving the sign-carrying face of the sign easily visible to traffic on the highway. This will provide a significant deterrent to would-be graffiti artists.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
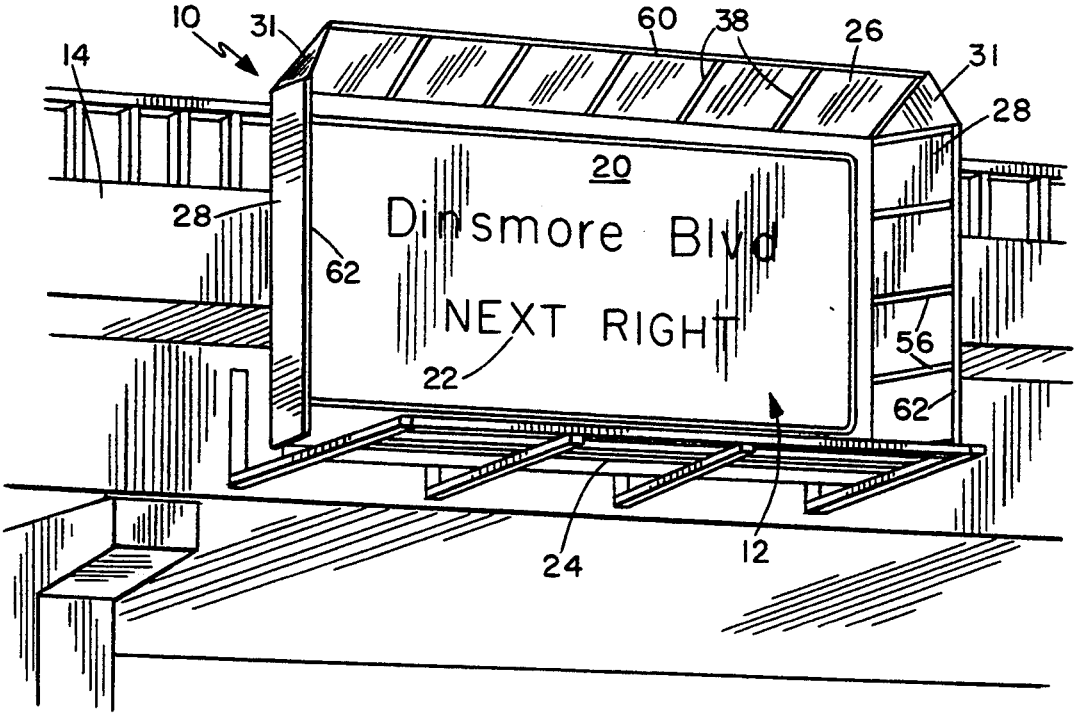
FIG. 1 is a pictorial view of a typical sign mounted on an overpass bridge, with a shield assembly according to a preferred embodiment of the invention in place.
Figure 2:
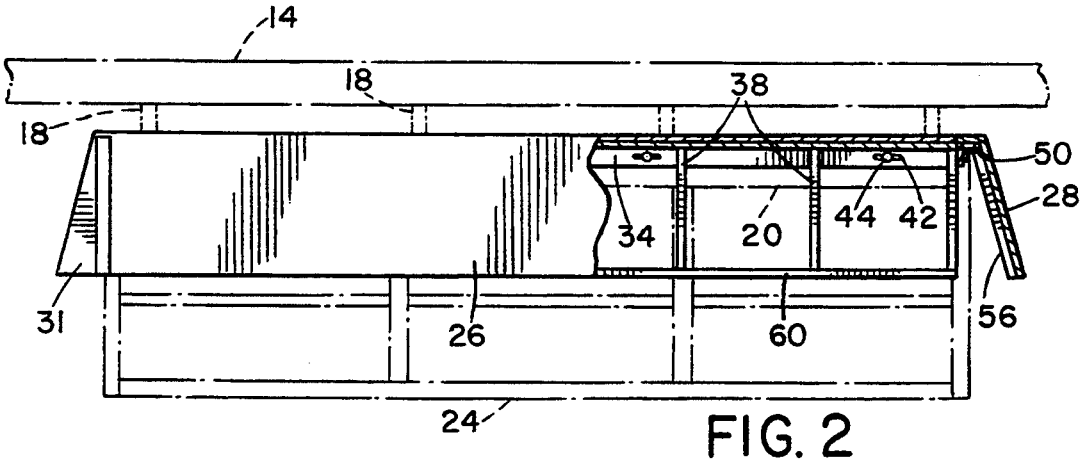
FIG. 2 is a top plan view of the structure with a portion of the top shield panel cut away.

A shield assembly 10 for surrounding and shielding the upper and side edges of a highway sign according to a preferred embodiment of the present invention is illustrated in the drawings. The shield assembly is mounted on a typical highway sign 12 on an overpass bridge 14, as illustrated in FIGS. 1 and 2. A typical highway sign includes a box-like supporting frame 16 which is secured to a front side of the bridge via supports 18, and a sheet or panel 20 carrying informational indicia 22 secured across a front face of the frame 16. A service platform or catwalk 24 is secured to the bridge so as to project out under the lower edge of the sign, for use by service personnel when changing lights, repainting or cleaning the sign.

The shield assembly 10 basically comprises an upper shield panel 26 and a pair of side panels 28 secured across the upper and opposite side edges of the sign, respectively, so as to surround and project outwardly from the front face or sheet 20. Upper and side edge mounting devices 30,32 are provided for securing the upper and side panels, respectively, to the sign frame 16 so that they project or flare outwardly from the front face or sheet 20 at an angle greater than 90° to the front face 20, as best illustrated in FIGS. 4–6.

Figure 3:
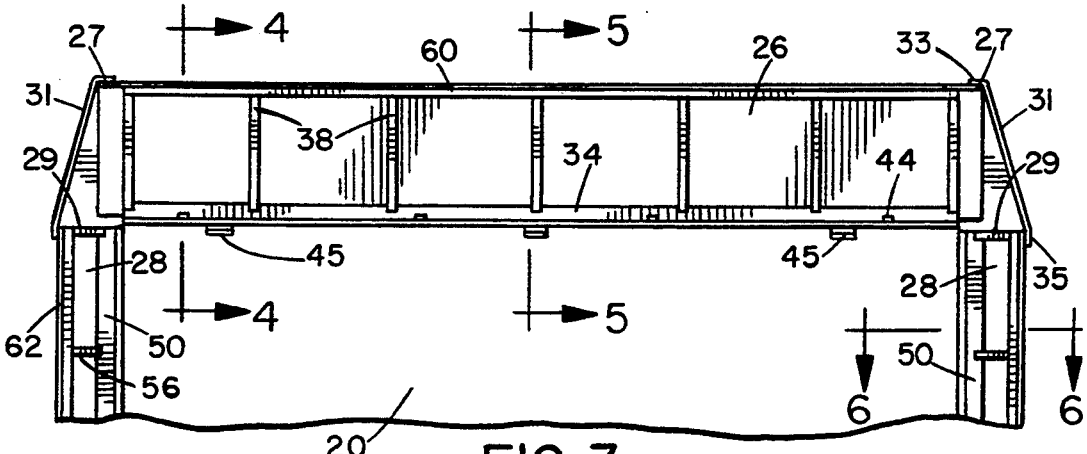
FIG. 3 is a front view of the upper portion of the shield.

This arrangement will leave trapezoidally-shaped gaps at the upper corners of the sign, between the opposite end edges 27 of the upper panel and the adjacent upper end edges 29 of the side panels, respectively. These gaps are filled with corner members 31 which comprise pieces of sheet metal cut to a trapezoidal shape which matches that of the gaps but is of slightly larger dimensions. The angled edges 33,35 of the trapezoidal corner members are bent around over the respective outer ends of the upper and side panels, respectively, as best illustrated in FIG. 3, and are suitably secured to the respective panel ends by welding, riveting, screw fasteners or the like. This forms a continuous, outwardly projecting rim or shield around the peripheral side and upper edges of the sign, significantly reducing visibility and accessibility of the front face of the sign from the bridge.

Figure 4:
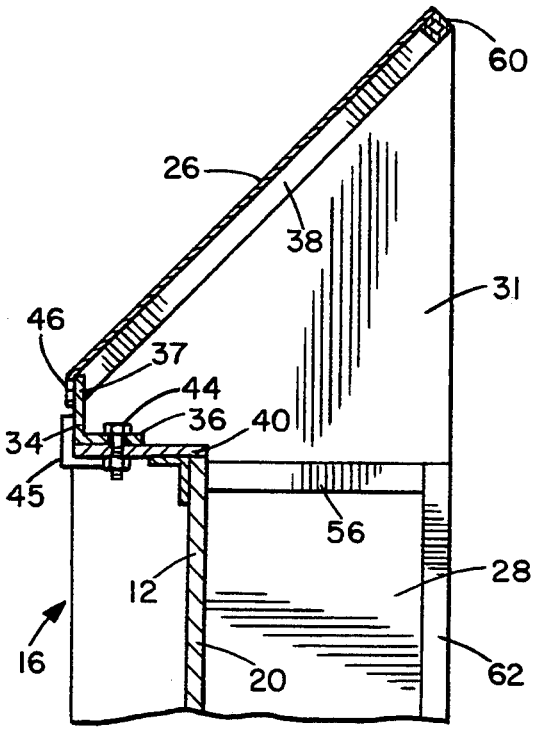
FIG. 4 is an enlarged sectional view taken on line 4—4 of FIG. 3.
Figure 5:
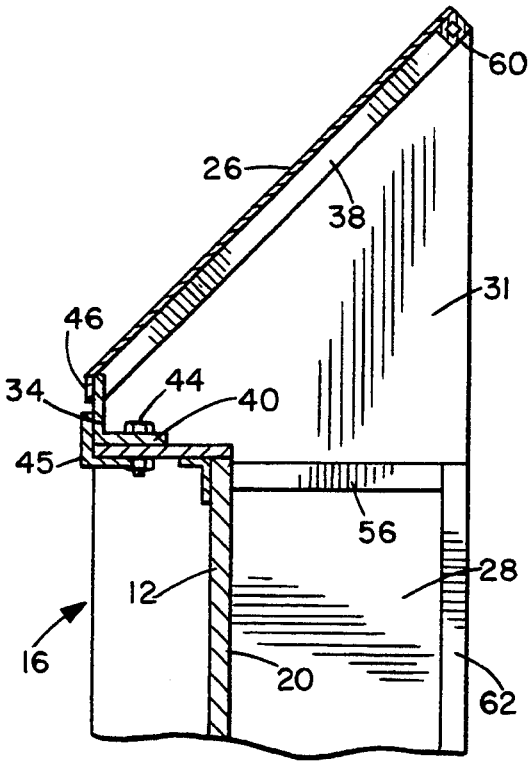
FIG. 5 is an enlarged sectional view taken on line 5—5 of FIG. 3.
Figure 6:
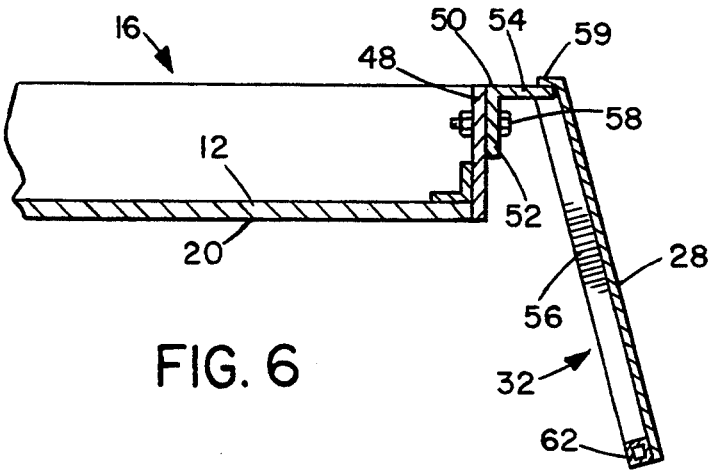
FIG. 6 is an enlarged sectional view taken on line 6—6 of FIG. 3.

As best illustrated in FIGS. 2, 4 and 5, the upper mounting device comprises an elongate angle bar 34 having perpendicular legs 36,37 and a plurality of spaced ribs or rafters 38 each secured at one end to the leg 37 so as to project outwardly at an angle of 45° to the leg 36. The ribs 38 are preferably each square section tubular members of suitable metal such as steel, and may be secured to the angle bar at the appropriate angle by welding, riveting or the like. The other leg 36 is adapted to be secured to an upper member 40 of the sign frame and has spaced slots 42 for this purpose which can be aligned with bolt holes conventionally provided on the upper members of such frames. The leg 36 can then be secured to the frame via bolts 44 extending through the aligned slots and holes, as illustrated in FIG. 4.

For additional stability when mounting the device onto a sign frame, a series of hook members 45 are welded to the angle bar 34 at spaced intervals along the length of angle bar 34, at locations between the slots 42. Each hook member 45 also comprises a perpendicular angle member having one part welded to the outer face of vertical leg 37 so that the other, perpendicular part extends parallel to and beneath leg 36. This forms a hook which can be hooked under the upper member 40 of the sign frame at the rear of the frame, as illustrated in FIGS. 4 and 5. Each of the hooks can be hooked under the member 40 when installing the assembly, holding the angle bar stably in the correct position while bolting it to the upper member 40.

The ribs 38 will project upwardly at an angle of 45° to the upper member of the sign frame, and form a support for upper panel 26 which is secured to the ribs via rivets, screws or welding. The panel 26 is preferably an elongate, thin sheet of metal such as galvanized sheet steel. Preferably, a rear edge 46 of the upper panel is bent downwardly over the vertical leg 36 of the angle bar for added security. Although the ribs 38 are arranged at an angle of 45° in the illustrated embodiment, it will be understood that other flare angles may be selected, although 45° has been found to significantly restrict visibility of the sign from above and to deter persons from attempting to climb over the upper panel, since they will be unable to see the sign even if they lean forward, and will only see the road below.

Each side panel 28 is secured to respective side members 48 of the frame in a similar manner, via side mounting devices 32 which are equivalent to upper mounting devices. Thus, each side mounting device 32 comprises an angle bar 50 having perpendicular legs 52,54, and a plurality of support or reinforcing ribs 56 secured to one of the legs 54 at spaced intervals so as to project outwardly at a predetermined angle. The other leg 52 of the angle bar is secured to the respective frame side member 48 via bolts 58 which extend through slots equivalent to the slots 42 in the angle bar of the upper mounting device. The side panels 28 are attached to the respective sets of ribs 56 by welding, riveting, screw fasteners or the like. The side panels are bent down along their respective rear edges 59 around the back of the assembly, in a similar manner to the bent edge 46 of the upper panel. The ribs project at an angle to the frame side member 48, as best illustrated in FIG. 6. The angle in the illustrated embodiment is less than 45°, although the side panels are preferably arranged to flare out at the same angle as the upper panel, i.e. 45°. This ensures that the sign is still easily visible from the highway, while shielding it from visibility or easy access from the bridge.

The upper panel 26 and side panels 28 are each preferably of relatively thin, lightweight sheet metal such as 24 gauge galvanized sheet steel, while the ribs 38 and 56 are square section metal tubes which will form a rigid support for the lightweight panels. Preferably, an additional length of reinforcing tubing 60, 62 is secured along the outer peripheral edge of the upper panel and each side panel, respectively, by welding, riveting, screw fasteners or the like. This will add further rigidity to the assembly.

The shield assembly can be installed relatively easily on any bridge-mounted highway sign. The side panels are first installed on the sides of the sign support frame 16. The upper panel is then mounted on the upper part of the frame. At this point, the corner members 31 are installed. The angle bars 34 and 50 may be provided in lengths matching those of typical highway sign upper and side edges, and are preferably 3" by 3" angle bars of 3/16" thickness. Preferably, the ribs are provided at 24" intervals or less. For longer or taller signs, more than one angle bar may be used to extend along the entire length of the sign edge. Similarly, the upper and side panels will be of length corresponding to that of the respective upper and side edges of the sign on which they are to be installed.

The upper panel, corner members and side panels are preferably formed separately for convenience in installation on an existing highway sign. In this way, each part of the assembly will be sufficiently lightweight to be installed readily by workers on the bridge or catwalk. However, they may be secured together or formed integrally as a three-sided frame, prior to installation on the sign itself, in alternative embodiments.

Once installed, the assembly forms an effective deterrent against potential graffiti artists attempting to spray paint onto the front of the sign from the bridge. They will be unable to see the sign from the safety of the bridge, even if they lean forward. This is because the panels shielding the sign project out to a distance of around two feet, while the sign supports 18 mounting the sign are typically up to one foot in length. This means that a person would need to lean out to a distance greater than three feet in order to see the sign, which would be very difficult if not impossible. The flaring out of the panels also adds to the difficulty, since it will impede the angle of vision of the sign from the bridge. It also makes it unlikely that individuals will attempt to climb around the shield assembly.

This shield assembly will therefore greatly reduce, if not eliminate, the incidence of graffiti on bridge-mounted highway signs. This in turn will reduce the expense and manpower needed in cleaning such signs to remove graffiti.

Although a preferred embodiment of the invention has been described above by way of example only, it will be understood by those skilled in the field that modifications may be made to the disclosed embodiment without departing from the scope of the invention, which is defined by the appended claims.

I claim:

1. A shield assembly for a highway sign having a flat front face for carrying informational indicia, comprising:

shield panel means for securing around at least an upper edge and opposite side edges of a highway sign having a flat front face, the panel means including means for projecting a predetermined distance outwardly from the front face of the sign;

the panel means comprising an upper shield panel for extending along the upper edge of a highway sign and a pair of side panels for securing along opposite side edges of the sign;

upper panel mounting means for supporting the upper shield panel along the upper edge of a sign, the upper panel mounting means including means for orienting the upper shield panel at an angle of greater than 90° to the front face of a sign when secured along the upper edge of the sign;

side panel mounting means for supporting the side panels;

the upper panel having opposite end edges and each side panel having an upper end edge spaced from the respective end edge of the upper panel at upper corners of the sign to form a trapezoidally shaped corner gap; and the assembly further including a pair of corner members for filling the respective corner gaps, each corner member being of shape substantially corresponding to that of the respective gap and being secured to the respective upper panel end edge and side panel upper edge.

2. The assembly as claimed in claim 1, wherein the upper and side shield panels are each of sheet metal.

3. The assembly as claimed in claim 1, wherein the upper and side panel mounting means each comprise an elongate support member for securing along the upper and side edges of the sign, respectively, and a plurality of reinforcing ribs projecting from the support member at spaced intervals along the length of each support member, each rib having a first end secured to the support member and projecting at a predetermined angle to the support member, and securing means for securing the respective panel across the reinforcing ribs.

4. The assembly as claimed in claim 3, wherein the reinforcing ribs are square-section tubular members.

5. The assembly as claimed in claim 3, wherein each elongate support member comprises an angle bar having a first leg for securing to an upper or side member, respectively, of a sign, and a second leg projecting perpendicular to the first leg outwardly from the sign.

6. The assembly as claimed in claim 5, wherein the first leg of each angle bar has a series of spaced slots for alignment with bolt holes in the sign upper and side member, respectively.

7. The assembly as claimed in claim 5, wherein the ribs are secured to the second leg of each angle bar.

8. The assembly as claimed in claim 5, wherein the ribs project at an angle between 0° and 45° to the first leg.

9. The assembly as claimed in claim 8, wherein the ribs on the upper mounting means project at an angle to the first leg of the upper mounting means which is greater than the angle of the ribs on the side mounting means to the first leg of the side mounting means.

10. The assembly as claimed in claim 8, wherein the ribs on the angle bar of at least the upper mounting means project at an angle of 45° to the first leg of the angle bar.

11. The assembly as claimed in claim 5, wherein the upper and side panels each have an outer peripheral edge and upper and side reinforcing ribs are secured along the outer peripheral edges of the upper and side panels, respectively.

12. The assembly as claimed in claim 5, wherein the angle bar of at least the upper mounting means has a series of spaced hook members along its length for hooking under the rear edge of a sign on installing the assembly.

13. The assembly as claimed in claim 3, wherein the side and upper panels each have a width of at least two feet.

14. A highway sign assembly, comprising:

a highway sign having a periphery comprising an upper edge, lower edge and spaced side edges, and a front face carrying information;

a peripheral frame secured around at least part of the periphery of the sign and projecting outwardly a predetermined distance from the front face of the sign;

the frame including an upper flat panel extending along the upper edge of the sign and flat side panels each extending along at least part of a respective side edge of the sign, the panels projecting outwardly from the front face of the sign and shielding the front face from view from above; and the side panels projecting at angles greater than 90° to the front face of the sign.

15. The assembly as claimed in claim 14, wherein the frame has only three sides and is open along the lower edge of the sign.

16. The assembly as claimed in claim 14, wherein the frame includes corner members extending between the side and upper panels at opposite upper corners of the sign.

17. The assembly as claimed in claim 14, wherein at least the upper panel projects at an angle of greater than 90° to the front face of the sign.

18. The assembly as claimed in claim 17, wherein the upper panel projects at an angle of 135° to the front face of the sign.

19. A shield assembly for a highway sign having a front face carrying information for highway users, the assembly comprising:

a three-sided frame for extending around at least the upper part of the periphery of a rectangular highway sign;

the frame comprising an upper elongate support member including a flat leg for securing along an upper edge of a sign, an upper shield panel mounted on the upper support member and extending along the length of the upper support member at an angle to said flat leg, whereby said upper shield panel projects outwardly at an angle of greater than 90° to the front face of a sign when said frame is secured to the sign, a pair of elongate side support members extending downwardly from opposite ends of said upper support member, and a pair of side shield panels each mounted on a respective one of the side support members and extending along the length of the respective side support members;

said upper and side support members each comprising means for supporting the respective upper and side shield panels to project outwardly a predetermined distance from the front face of a sign around which the frame is mounted;

the upper panel having opposite end edges and the side panels each having an upper end edge spaced from the respective end edge of the upper panel at upper corners of the frame to form a gap; and a pair of corner members for filling the respective corner gaps, each corner member being of shape substantially corresponding to that of the respective gap and being secured to the respective upper panel end edge and side panel upper edge.

20. A shield assembly for a highway sign having a flat front face for carrying informational indicia, comprising:

a peripheral frame for securing around at least part of the periphery of a sign and projecting outwardly a predetermined distance from the front face of the sign, the frame at least partially surrounding and defining a mounting plane for a sign secured to the frame;

the frame including an upper flat panel for extending along an upper edge of the sign and a pair of side shield panels each comprising means for securing along at least part of a respective side edge of the sign;

the upper panel being oriented at an angle of greater than 90° to the mounting plane;

the upper panel having opposite end edges and each side panel having an upper end edge spaced from the respective end edge of the upper panel to form a corner gap; and the assembly further including a pair of corner members for filling the respective corner gaps, each corner member being of shape substantially corresponding to the shape of the respective corner gap and being secured to the respective upper panel end edge and side panel upper edge.

* * * * *